US007523823B1

(12) United States Patent
Bednar

(10) Patent No.: US 7,523,823 B1
(45) Date of Patent: Apr. 28, 2009

(54) MIXING CONTAINER SYSTEM

(76) Inventor: Thomas R. Bednar, N41 W27220 Roger Rd., Pewaukee, WI (US) 53072

( * ) Notice: Subject to any disclaimer, the term of this patent is extended or adjusted under 35 U.S.C. 154(b) by 391 days.

(21) Appl. No.: 11/563,046

(22) Filed: Nov. 24, 2006

(51) Int. Cl.
*B65D 25/08* (2006.01)

(52) U.S. Cl. ..... 206/222; 206/221; 206/568

(58) Field of Classification Search ..... 206/219, 206/220, 221, 222, 514, 515, 226, 568; 220/501, 220/502; 222/80, 81; 426/86, 139, 115, 426/120

See application file for complete search history.

(56) References Cited

U.S. PATENT DOCUMENTS

| | | | | | |
|---|---|---|---|---|---|
| 2,462,497 | A * | 2/1949 | Heyman | 426/139 |
| 3,278,014 | A * | 10/1966 | Thornton | 206/217 |
| 3,348,716 | A | 10/1967 | Nakata | |
| 3,502,206 | A * | 3/1970 | Irvin et al. | 206/221 |
| 3,856,138 | A * | 12/1974 | Maekawa et al. | 206/221 |
| 4,141,468 | A * | 2/1979 | Funaro | 222/105 |
| 4,233,325 | A * | 11/1980 | Slangan et al. | 426/107 |
| 4,444,324 | A | 4/1984 | Grenell | |
| 4,537,044 | A | 8/1985 | Putnam | |
| 4,793,323 | A * | 12/1988 | Guida et al. | 126/263.08 |
| 4,794,008 | A * | 12/1988 | Schmidt et al. | 426/234 |
| 5,485,921 | A | 1/1996 | Tolendano | |
| D369,723 | S | 5/1996 | McArthur et al. | |
| 5,660,299 | A | 8/1997 | Harvey | |
| 5,884,796 | A | 3/1999 | Hallmark | |
| 6,528,105 | B1 * | 3/2003 | Gerhart et al. | 426/394 |
| 6,610,339 | B1 | 8/2003 | Borgerson | |
| 6,622,615 | B2 | 9/2003 | Heczko | |
| 6,641,854 | B2 | 11/2003 | Gerhart et al. | |
| 6,705,109 | B2 | 3/2004 | DeMars | |
| 6,708,735 | B1 | 3/2004 | Kenihan | |
| 6,852,381 | B2 | 2/2005 | Debraal et al. | |
| 6,889,826 | B2 * | 5/2005 | Harada et al. | 206/219 |
| 6,945,393 | B2 * | 9/2005 | Cho | 206/219 |
| 2003/0172671 | A1 | 9/2003 | DeMars | |
| 2004/0124114 | A1 | 7/2004 | Sellers | |
| 2005/0255201 | A1 | 11/2005 | Gruhot et al. | |
| 2007/0227919 | A1 * | 10/2007 | True | 206/219 |

FOREIGN PATENT DOCUMENTS

| | | |
|---|---|---|
| GB | 425778 | 12/2004 |
| JP | 8133349 | 5/1996 |
| WO | WO2005/028333 | 3/2005 |

* cited by examiner

*Primary Examiner*—Luan K Bui
*Assistant Examiner*—Chun Cheung

(57) ABSTRACT

A mixing container system for separating two or more ingredients and maintaining multiple temperatures of the two or more ingredients. The mixing container system includes an outer unit including a support member, a pouch member including at least one first reservoir portion and an inner unit including a second reservoir portion, wherein the pouch member is positioned on the support member and wherein the second reservoir portion of the inner unit extends through the outer unit sandwiching the pouch member between the inner unit and the outer unit. The first reservoir portion contains at least one first substance and the second reservoir portion contains a second substance, wherein the first substance is forced out of the first reservoir portion and into the second reservoir portion.

20 Claims, 8 Drawing Sheets

MIXING CONTAINER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to containers and more specifically it relates to a mixing container system for separating two or more ingredients and maintaining multiple temperatures of the two or more ingredients.

2. Description of the Related Art

Any discussion of the prior art throughout the specification should in no way be considered as an admission that such prior art is widely known or forms part of common general knowledge in the field.

Containers have been in use for years. Typically, containers come in many configurations and are used for many applications. One such application that containers are commonly used for is holding food ingredients. When using a container to hold food ingredients all the ingredients included in the container are generally in contact with each other, which may not always be desired.

Previous containers have included several compartments for separating different ingredients, such as cereal and milk. However these multiple compartment containers generally keep food at a single temperature, such as a hot temperature or a cold temperature and are not generally capable of maintaining multiple temperatures for multiple ingredients.

It may be desired at times to maintain multiple different temperatures for multiple ingredients within a single container. One such instance where multiple temperatures are desired is during the preparation of a hot fudge sundae. Generally when preparing a hot fudge sundae the fudge is layered over the top of the ice cream which cools the fudge and melts the ice cream. This may lead to dissatisfaction of the consumer of the hot fudge sundae in that the hot fudge sundae is not generally served or eaten at an ideal temperature.

While these devices may be suitable for the particular purpose to which they address, they are not as suitable separating two or more ingredients and maintaining multiple temperatures of the two or more ingredients. When mixing different temperature ingredients in a container the ingredients generally adapt to each others temperature which can lead to dissatisfaction in the consumer of the ingredients.

In these respects, the mixing container system according to the present invention substantially departs from the conventional concepts and designs of the prior art, and in so doing provides an apparatus primarily developed for the purpose of separating two or more ingredients and maintaining multiple temperatures of the two or more ingredients.

BRIEF SUMMARY OF THE INVENTION

In view of the foregoing disadvantages inherent in the known types of mixing cups now present in the prior art, the present invention provides a new mixing container system construction wherein the same can be utilized for separating two or more ingredients and maintaining multiple temperatures of the two or more ingredients.

The general purpose of the present invention, which will be described subsequently in greater detail, is to provide a new mixing container system that has many of the advantages of the containers mentioned heretofore and many novel features that result in a new mixing container system which is not anticipated, rendered obvious, suggested, or even implied by any of the prior art containers, either alone or in any combination thereof.

To attain this, the present invention generally comprises an outer unit including a support member, a pouch member including at least one first reservoir portion and an inner unit including a second reservoir portion, wherein the pouch member is positioned on the support member and wherein the second reservoir portion of the inner unit extends through the outer unit sandwiching the pouch member between the inner unit and the outer unit. The first reservoir portion contains at least one first substance and the second reservoir portion contains a second substance, wherein the first substance is forced out of the first reservoir portion and into the second reservoir portion.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a mixing container system that will overcome the shortcomings of the prior art devices.

A second object is to provide a mixing container system for separating two or more ingredients and maintaining multiple temperatures of the two or more ingredients.

Another object is to provide a mixing container system that includes at least two separate container systems.

An additional object is to provide a mixing container system that allows food ingredients to maintain their original temperature for a longer duration.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
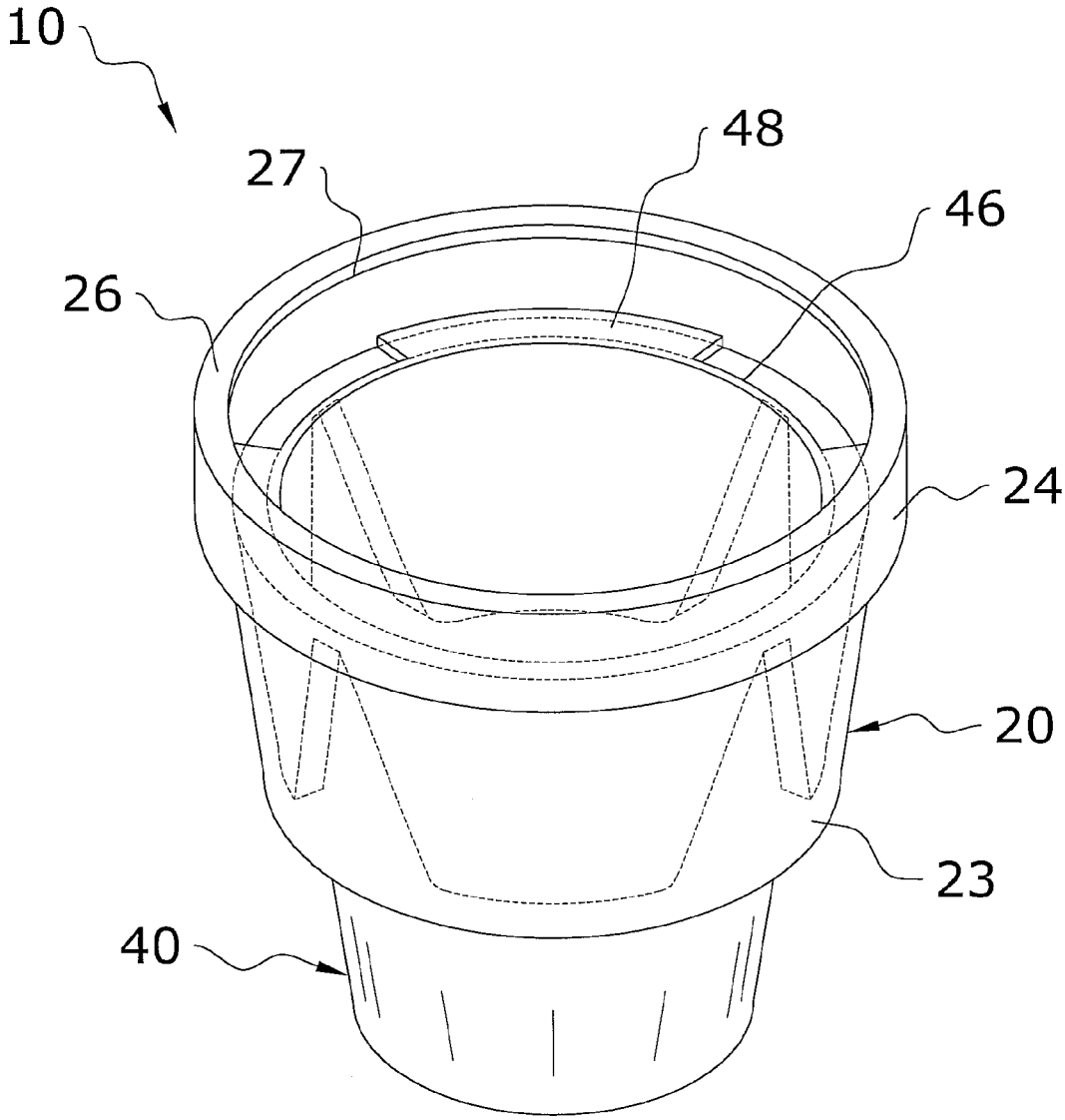
FIG. 1 is an upper perspective view of the present invention.

Turning now descriptively to the drawings, in which similar reference characters denote similar elements throughout the several views, FIGS. 1 through 8 illustrate a mixing container system 10, which comprises an outer unit 20 including a support member 28, a pouch member 30 including at least one first reservoir portion 32 and an inner unit 40 including a second reservoir portion 42, wherein the pouch member 30 is positioned on the support member 28 and wherein the second reservoir portion 42 of the inner unit 40 extends through the outer unit 20 sandwiching the pouch member 30 between the inner unit 40 and the outer unit 20. The first reservoir portion 32 contains at least one first substance 12 and the second reservoir portion 42 contains a second substance 14, wherein the first substance 12 is forced out of the first reservoir portion 32 and into the second reservoir portion 42.

B. Outer Unit

The outer unit 20 is preferably comprised of a sleeve configuration. The outer unit 20 is preferably comprised of an insulating material, such as but not limited to foam or plastic. A first inner diameter of the outer unit 20 is preferably substantially similar to a first outer diameter of the inner unit 40, wherein the outer unit 20 removably attaches to an outside of the inner unit 40 as shown in FIGS. 1 through 8.

Figure 4:
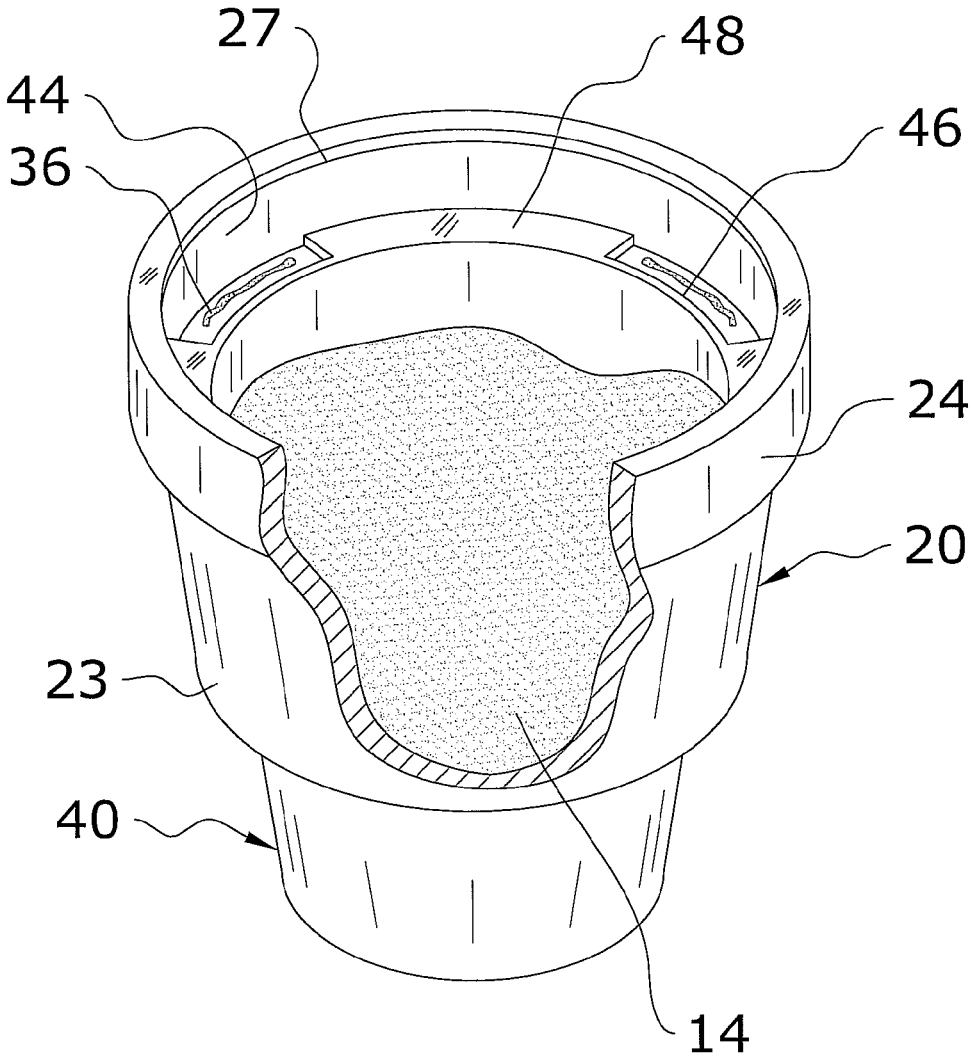
FIG. 4 is a cutaway upper perspective view of the present invention in use with the openings slit into the pouch member.
Figure 5:
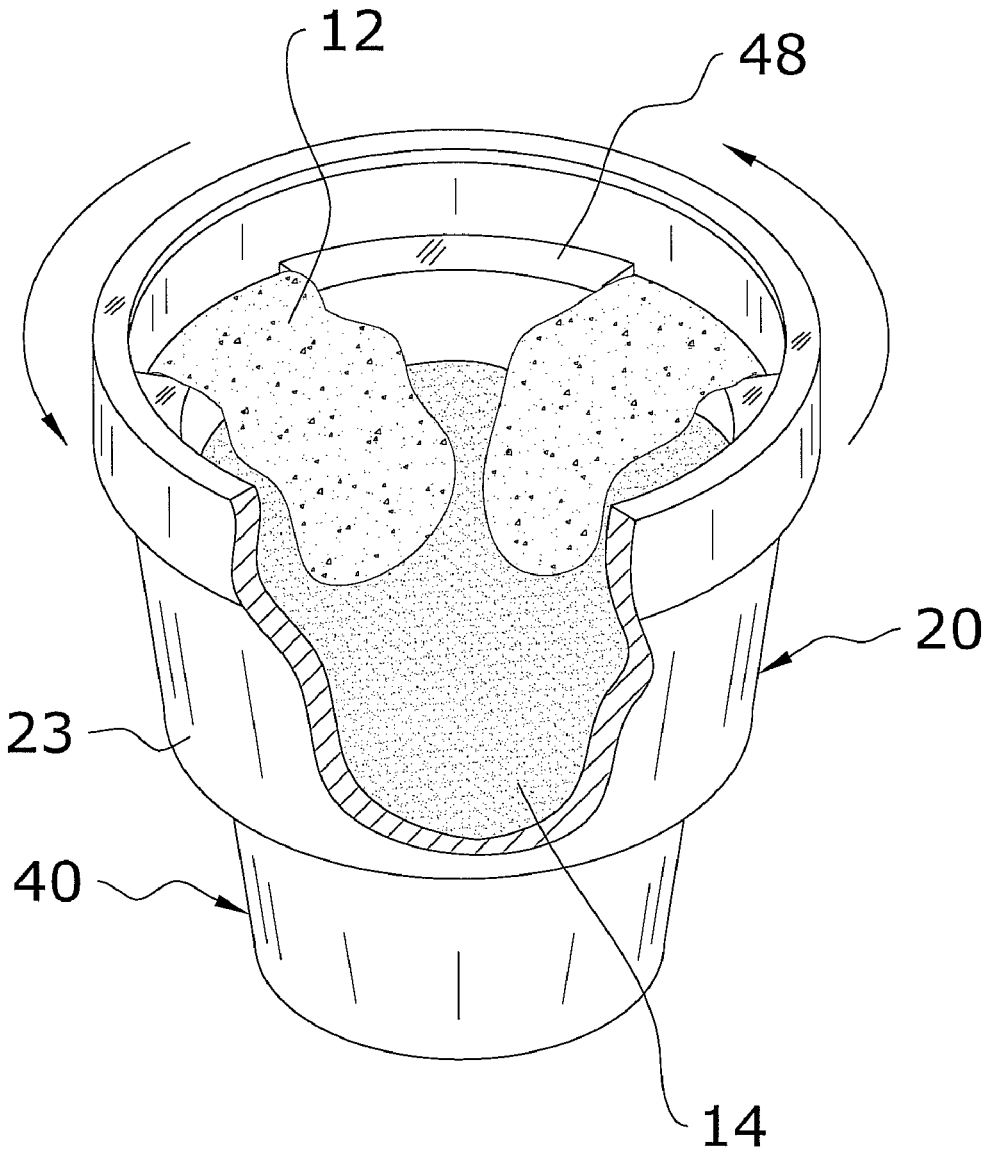
FIG. 5 is a cutaway upper perspective view of the present invention in use and rotating the outer unit about the inner unit thus mixing the first substance with the second substance.
Figure 6:
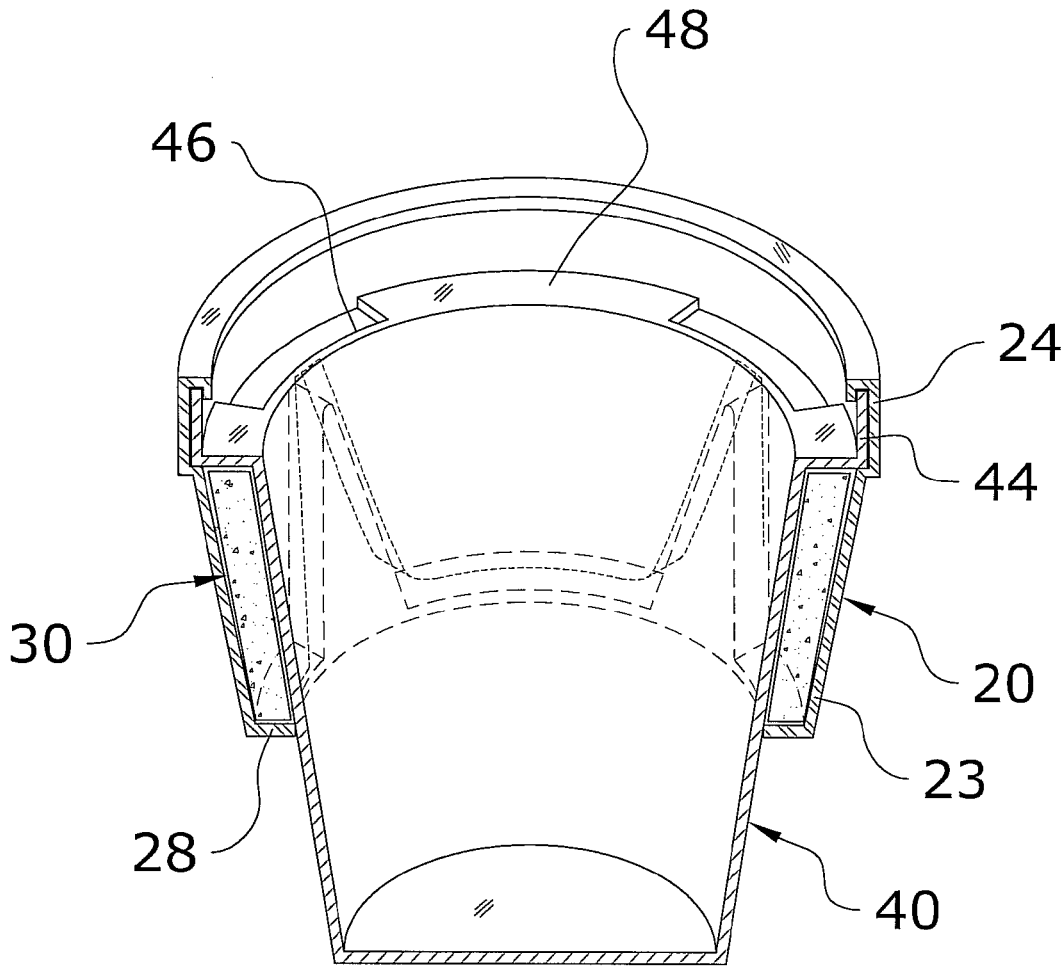
FIG. 6 is an upper perspective cross-sectional view of the present invention.

The outer unit 20 preferably includes a first receiving portion 23 as shown in FIGS. 1 through 8. The first receiving portion 23 is preferably comprised of a cylindrical configuration. The first receiving portion 23 preferably includes a support member 28. The support member 28 is preferably positioned substantially near a lower end of the first receiving portion 23. The support member 28 is preferably comprised of a circular configuration. The support member 28 also preferably extends inwardly from the lower end of the first receiving portion 23. A second inner diameter of the support member 28 is preferably substantially similar to a second outer diameter of the second reservoir portion 42 of the inner unit 40 as illustrated in FIG. 6.

Figure 2:
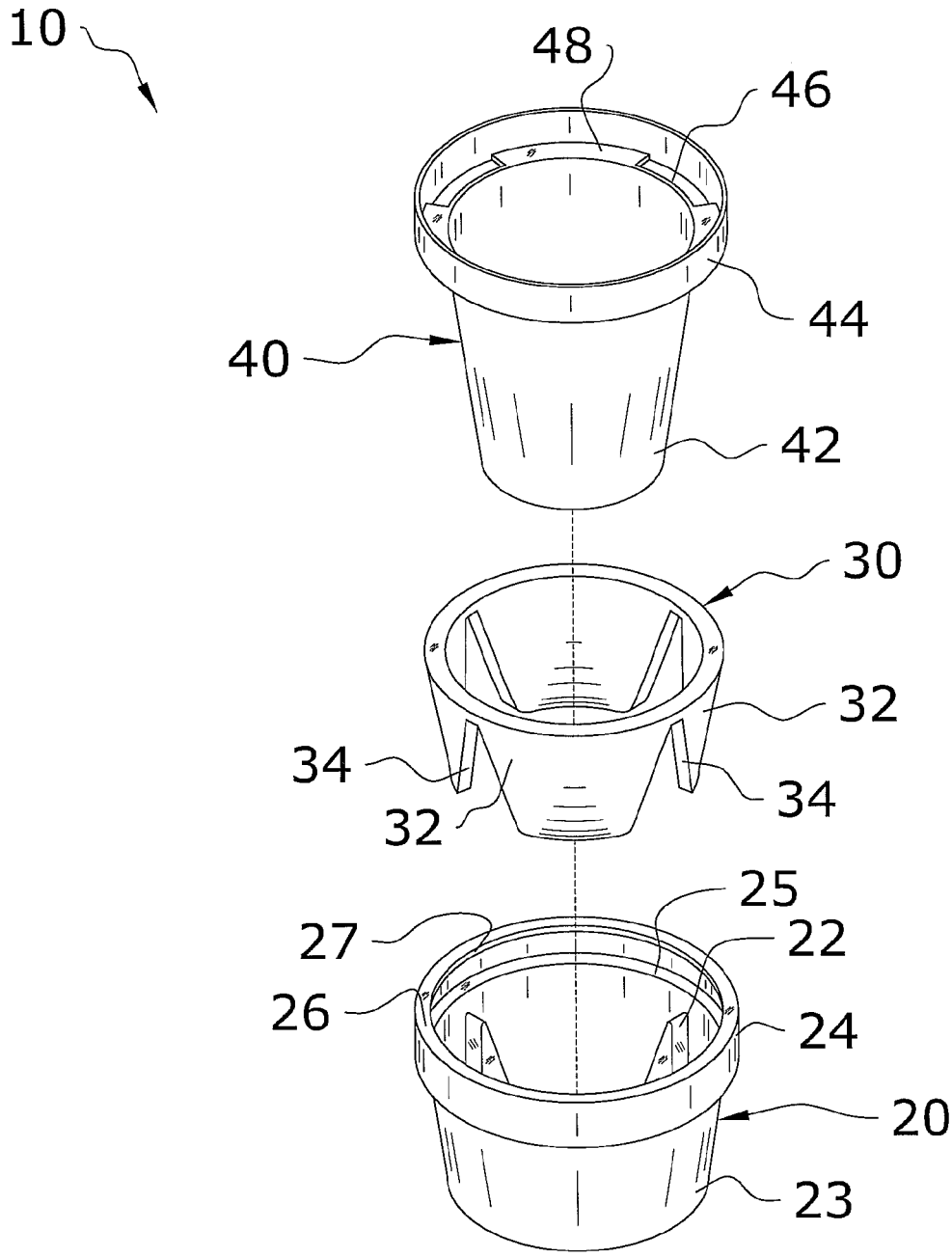
FIG. 2 is an exploded upper perspective view of the present invention.
Figure 7:
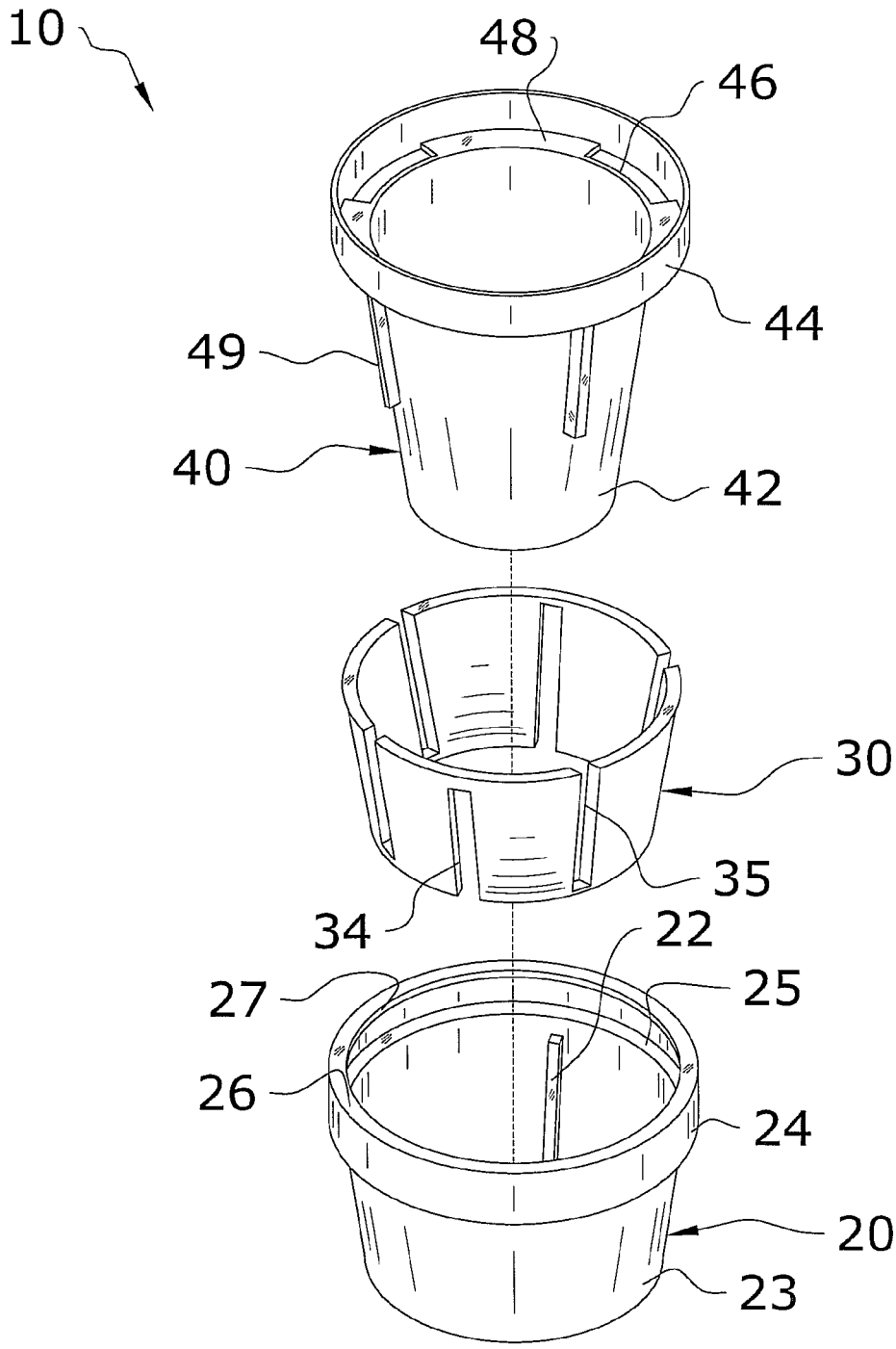
FIG. 7 is an exploded upper perspective view of an alternate embodiment of the present invention.
Figure 8:
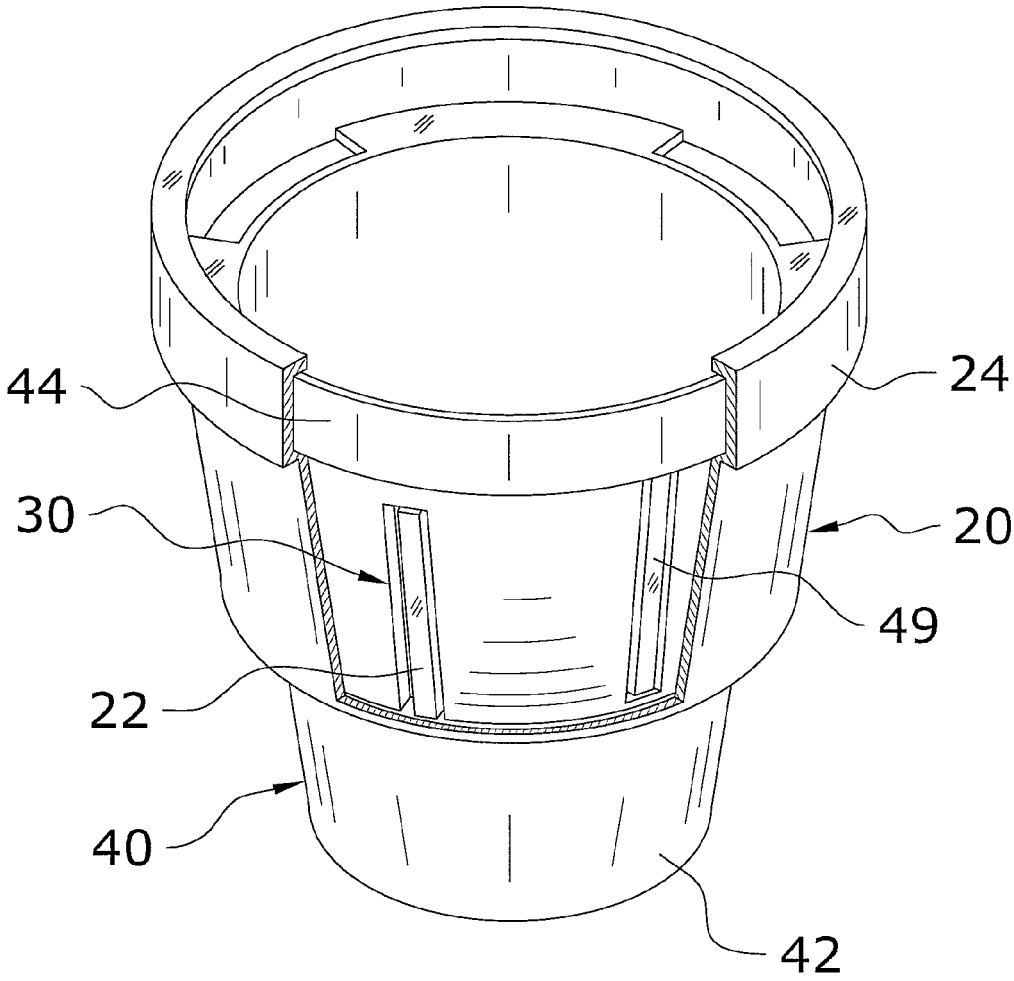
FIG. 8 is an upper perspective view of the alternate embodiment of the present invention.

The first receiving portion 23 also preferably includes a plurality of first rib members 22 preferably extending upwardly from the support member 28. The first rib members 22 are preferably radially positioned around the first receiving portion 23. The first rib members 22 are further preferably equidistant from one another. The first rib members 22 are also preferably positioned on an inner side of the first receiving portion 23. The first rib members 22 are also preferably comprised of an elongated configuration. The first rib members 22 may be comprised of various configurations, such as but not limited to triangular and rectangular as shown in FIGS. 2, 7 and 8.

The outer unit 20 also preferably includes a second receiving portion 24 as shown in FIGS. 1 through 8. The second receiving portion 24 is preferably comprised of a cylindrical configuration. The second receiving portion 24 also preferably extends upwardly from the first receiving portion 23. A third outer diameter of the first receiving portion 23 is also preferably substantially smaller than a fourth outer diameter of the second receiving portion 24.

The second receiving portion 24 preferably includes a first guide member 25 and a second guide member 26. The first guide member 25 and the second guide member 26 are preferably comprised of circular configurations. The first guide member 25 and the second guide member 26 also preferably extend inwardly from the second receiving portion 24 as shown in FIGS. 2 and 6.

The first guide member 25 preferably extends inwardly from a lower end of the second receiving portion 24. The second guide member 26 preferably extends inwardly from an upper end of the second receiving portion 24. The second guide member 26 also preferably includes a lip portion 27. The lip portion 27 preferably extends in a vertically downward manner from an inner most side of the second guide member 26 as shown in FIG. 6.

C. Pouch Member

The pouch member 30 is preferably comprised of a flexible pouch configuration. The pouch member 30 preferably contains a first substance 12. A fifth outer diameter of the pouch member 30 is preferably substantially similar to a third inner diameter of the first receiving portion 23 of the outer unit 20. A fourth inner diameter of the pouch member 30 is preferably substantially similar to the second outer diameter of the second reservoir portion 42 of the inner unit 40 as illustrated in FIGS. 2 and 6. A first height of the pouch member 30 is also preferably substantially similar to a second height of the first receiving portion 23 of the outer unit 20.

The pouch member 30 preferably includes a plurality of first reservoir portions 32. The first reservoir portions 32 preferably contain the first substance 12. The pouch member 30 also preferably includes a plurality of first attachment portions 34 extending between the plurality of first reservoir portions 32. The first attachment portions 34 of the pouch member 30 are preferably comprised of a substantially similar configuration as the first rib members 22. It is appreciated that each of the first reservoir portions 32 of the pouch member 30 may contain different first substances 12 to mix with the second substance 14.

In an alternate configuration of the mixing container system 10 the pouch member 30 preferably includes a plurality of first attachment portions 34 extending upwardly from a lower end of the pouch member 30 to receive the first rib members 22 of the outer unit 20. The pouch member 30 also preferably includes a plurality of second attachment portions 35 extending downward from an upper end of the pouch member 30 to receive the second rib members 49 of the inner unit 40 as illustrated in FIGS. 2 and 7. It is appreciated that the pouch member 40 may also be bonded or attached to the inner unit 40 to prevent the pouch member 30 from rotating along with the outer unit 20.

D. Inner Unit

The inner unit 40 is preferably comprised of a cup configuration as shown in FIGS. 1 through 8. The inner unit 40 is also preferably comprised of an insulating material, such as but not limited to foam or plastic. A first temperature of the first substance 12 is preferably maintained within the pouch member 30 while a second temperature of the second substance 14 is maintained by the inner unit 40.

The inner unit 40 preferably includes a second reservoir portion 42. The second reservoir portion 42 preferably contains the second substance 14. The second reservoir portion 42 also preferably is positionable within the first receiving portion 23 of the outer unit 20 as shown in FIGS. 1 through 8. The second reservoir portion 42 is further preferably comprised of a cylindrical configuration. An outer wall of the second reservoir portion 42 also preferably forms an inner wall for the pouch member 30 when the pouch member 30 is positioned between the outer unit 20 and the inner unit 40.

The inner unit 40 also preferably includes a plurality of separating members 48 radially extending outwardly from the second reservoir portion 42 as shown in FIGS. 1 through 8. The separating members 48 preferably extend outwardly from an upper end of the second reservoir portion 42. A sixth outer diameter of the separating members 48 is also preferably substantially similar to the third inner diameter of first receiving portion 23 of the outer unit 20 as illustrated in FIG. 6.

A plurality of slots 46 preferably extend between the plurality of separator members as shown in FIGS. 1 through 8. The slots 46 preferably receive the first substance 12 from the pouch member 30 when the outer unit 20 is rotated about the inner unit 40.

The inner unit 40 also preferably includes a connecting member 44. The connecting member 44 preferably extends upwardly from an outer end of the separating members 48. A seventh outer diameter of the connecting member 44 is also preferably substantially similar to the fourth outer diameter of second receiving portion 24 of the outer unit 20 as illustrated in FIG. 6.

A second height of the connecting member 44 is preferably substantially similar to a first vertical distance between the first guide member 25 and the second guide member 26, wherein the connecting member 44 is positionable between the first guide member 25 and the second guide member 26. A first width of the connecting member 44 is also preferably substantially similar to a second width of the first guide member 25 and a third width of the second guide member 26 as shown in FIG. 6. The inner unit 40 preferably rotates within the outer unit 20 via the connecting member 44 rotating within the second receiving portion 24.

In the alternate configuration of the mixing container system 10 the inner unit 40 preferably includes a plurality of second rib members 49 extending downward from the separating members 48 as shown in FIGS. 7 and 8. The plurality of second rib members 49 preferably receive a plurality of second attachment portions 35 of the pouch member 30. The plurality of second rib members 49 are preferably comprised of an elongated configuration. The plurality of second rib members 49 may be comprised of various configurations, such as but not limited to rectangular or triangular.

E. In Use

Figure 3:
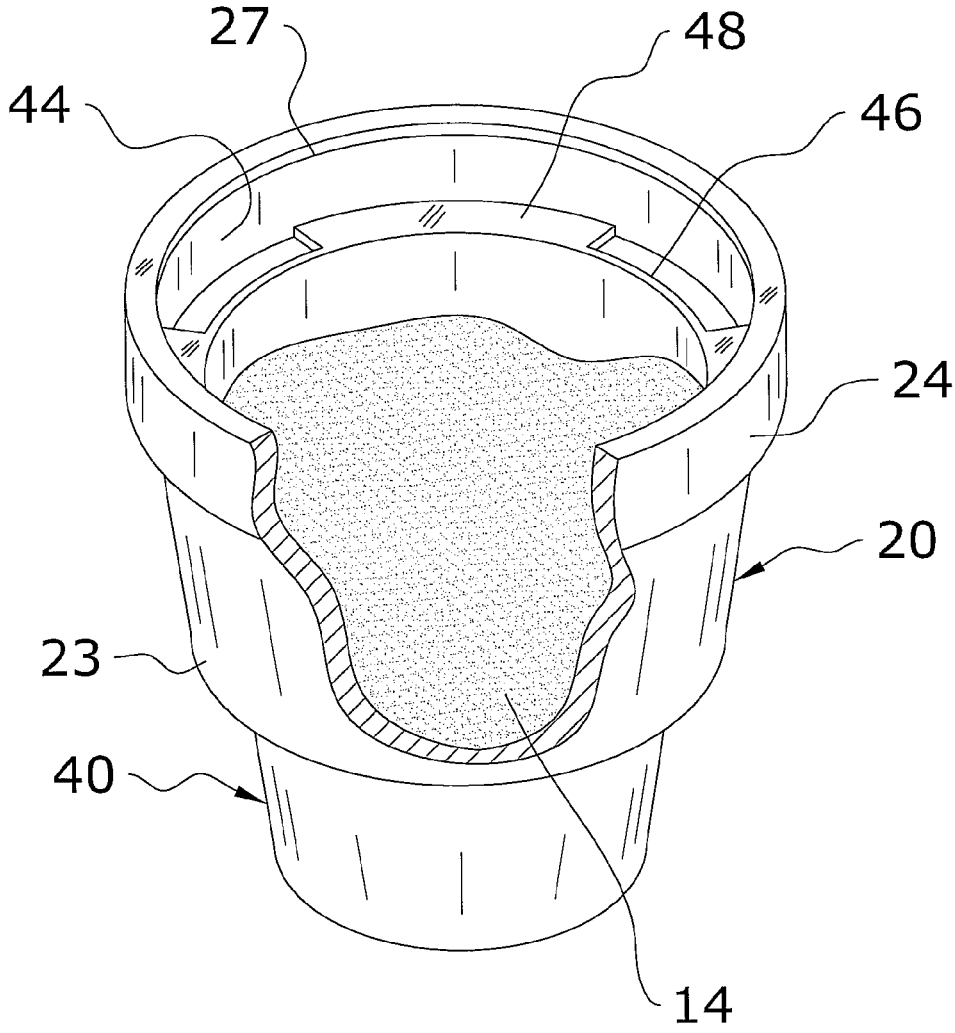
FIG. 3 is a cutaway upper perspective view of the present invention in use.

In use, the pouch member 30 is first positioned within the outer unit 20 so the first attachment portions 34 are positioned over the first rib members 22. The inner unit 40 is then extended through the second receiving portion 24 of the outer unit 20 and then through the first receiving portion 23 of the outer unit 20. Once the upper end of the inner unit 40 is at a substantially similar height to the upper end of the outer unit 20 the connecting member 44 may be positioned between the first guide member 25 and the second guide member 26 of the outer unit 20 as shown in FIGS. 3 and 6.

The pouch member 30 bonds or attaches to the inner unit 40 after insertion. The first substance 12 (i.e. fudge) within the pouch member 30 may now be heated if desired by placing the mixing container system 10 in a microwave or other heating device. The second substance 14 (i.e. ice cream) is then put into the second receiving portion 42 of the inner unit 40. When the first substance 12 is desired to be mixed with the second substance 14, openings 36 are slit into the upper end of the pouch member 30 where the pouch member 30 is exposed by the slots 46 as illustrated in FIG. 4.

The outer unit 20 is now rotated about the inner unit 40, thus forcing the first reservoir portions 32 of the pouch member 30 against the first rib members 22 of the outer unit 20 and subsequently forcing the first substance 12 out of the pouch member 30 via the openings 36 and into the second reservoir portion 42 as shown in FIG. 5. It is appreciated that the first substance 12 may be mixed with the second substance 14 in various methods rather than the preferred method, such as but not limited to squeezing outer unit 20 against the inner unit 40 or pushing up on the pouch member 30 both of which force the first substance 12 through the slots 46 in the inner unit 40.

The outer unit 20 is continued to be rotated until a desired amount of the first substance 12 is mixed in with the second substance 14 of the second reservoir portion 42. The user may now eat the first substance mixed with the second substance (i.e. hot fudge sundae). When the user is finished utilizing the mixing container system 10 the mixing container system 10 may be disassembled by simply reversing the above process. The mixing container system 10 may now be washed and stored for later use.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A mixing container system, comprising:

an outer unit including a support member, wherein said outer unit is comprised of a sleeve configuration;

a pouch member including at least one first reservoir portion, wherein said at least one first reservoir portion contains at least one first substance and wherein said pouch member is positioned on said support member; and an inner unit including a second reservoir portion, wherein said second reservoir portion contains a second substance and wherein said second reservoir portion of said inner unit extends through said outer unit and said pouch member sandwiching said pouch member between said inner unit and said outer unit;

wherein said first substance is forced out of said at least one first reservoir portion and into said second reservoir portion.

2. The mixing container system of claim 1, wherein said inner unit includes a plurality of separator members and a plurality of slots extending between said plurality of separator members.

3. The mixing container system of claim 2, wherein said plurality of slots receive a substantially controlled flow of said first substance.

4. The mixing container system of claim 2, wherein said separator members are radially positioned around said inner unit.

5. The mixing container system of claim 2, wherein said pouch member includes a plurality of openings, wherein said plurality of openings substantially align with said plurality of slots.

6. The mixing container system of claim 2, wherein said inner unit includes a connecting member extending from said plurality of separator members and wherein said outer unit includes a second receiving portion, wherein said connecting member attaches to said second receiving portion.

7. The mixing container system of claim 6, wherein said connecting member is rotatably attached to said second receiving portion.

8. The mixing container system of claim 1, wherein said pouch member is comprised of a sleeve configuration.

9. The mixing container system of claim 1, wherein said outer unit includes a plurality of first rib members.

10. The mixing container system of claim 9, wherein said pouch member includes a plurality of first attachment portions extending between said at least one first reservoir portion, wherein said plurality of first rib members engage said plurality of first attachment portions.

11. A mixing container system, comprising:

an outer unit including a support member, wherein said outer unit is comprised of a substantially tubular configuration;

a pouch member including at least one first reservoir portion, wherein said at least one first reservoir portion contains at least one first substance and wherein said pouch member is positioned on said support member; and an inner unit including a second reservoir portion, a plurality of separator members and a plurality of slots extending between said plurality of separator members, wherein said second reservoir portion contains a second substance and wherein said second reservoir portion of said inner unit extends through said outer unit and said pouch member sandwiching said pouch member between said inner unit and said outer unit;

wherein said first substance is forced out of said at least one first reservoir portion and into said second reservoir portion.

12. The mixing container system of claim 11, wherein said plurality of slots receive a substantially controlled flow of said first substance.

13. The mixing container system of claim 11, wherein said separator members are radially positioned around said inner unit.

14. The mixing container system of claim 11, wherein said pouch member includes a plurality of openings, wherein said plurality of openings substantially align with said plurality of slots.

15. The mixing container system of claim 11, wherein said inner unit includes a connecting member extending from said plurality of separator members and wherein said outer unit includes a second receiving portion, wherein said connecting member attaches to said second receiving portion.

16. The mixing container system of claim 15, wherein said connecting member is rotatably attached to said second receiving portion.

17. The mixing container system of claim 11, wherein said pouch member is comprised of a sleeve configuration.

18. The mixing container system of claim 11, wherein said outer unit includes a plurality of first rib members.

19. The mixing container system of claim 18, wherein said pouch member includes a plurality of first attachment portions extending between said at least one first reservoir portion, wherein said plurality of first rib members engage said plurality of first attachment portions.

20. A mixing container system, comprising:

an outer unit including a support member, wherein said outer unit is comprised of a substantially tubular configuration;

a pouch member including at least one first reservoir portion, wherein said at least one first reservoir portion contains at least one first substance and wherein said pouch member is positioned on said support member;

wherein said pouch member is comprised of a sleeve configuration; and an inner unit including a second reservoir portion, a plurality of separator members and a plurality of slots extending between said plurality of separator members, wherein said second reservoir portion contains a second substance and wherein said second reservoir portion of said inner unit extends through said outer unit and said pouch member sandwiching said pouch member between said inner unit and said outer unit;

wherein said first substance is forced out of said at least one first reservoir portion and into said second reservoir portion;

wherein said plurality of slots receive a substantially controlled flow of said first substance;

wherein said separator members are radially positioned around said inner unit;

wherein said pouch member includes a plurality of openings, wherein said plurality of openings substantially align with said plurality of slots;

wherein said inner unit includes a connecting member extending from said plurality of separator members;

wherein said outer unit includes a second receiving portion, wherein said connecting member attaches to said second receiving portion;

wherein said connecting member is rotatably attached to said second receiving portion;

wherein said outer unit includes a plurality of first rib members;

wherein said pouch member includes a plurality of first attachment portions extending between said at least one first reservoir portion, wherein said plurality of first rib members engage said plurality of first attachment portions.

* * * * *